US005111857A

United States Patent [19]

LaWarre, Sr.

[11] Patent Number: 5,111,857

[45] Date of Patent: May 12, 1992

[54] CENTER SUPPLY TUBE FOR A CONTAINER FILLING ASSEMBLY

[75] Inventor: Robert W. LaWarre, Sr., Titusville, Fla.

[73] Assignee: Lawarre Precision Technologies, Inc., Titusville, Fla.

[21] Appl. No.: 631,387

[22] Filed: Dec. 20, 1990

[51] Int. Cl.[5] ..... B65B 3/12

[52] U.S. Cl. ..... 141/234; 141/99; 141/144; 141/284

[58] Field of Search ..... 141/99, 144, 145, 146, 141/147, 148, 234, 237, 250, 284

[56] References Cited

U.S. PATENT DOCUMENTS

| | | | |
|---|---|---|---|
| 2,760,704 | 8/1956 | Fechheimer | 141/145 X |
| 4,489,769 | 12/1984 | Catelli | 141/91 |
| 4,537,230 | 8/1985 | Schindel | 141/146 |
| 4,817,683 | 4/1989 | Laub, III | 141/144 X |

FOREIGN PATENT DOCUMENTS

| | | | |
|---|---|---|---|
| 390770 | 12/1922 | Fed. Rep. of Germany | 141/145 |
| 2736206 | 7/1979 | Fed. Rep. of Germany | 141/148 |

*Primary Examiner*—Ernest G. Cusick

*Attorney, Agent, or Firm*—Reising, Ethington, Barnard, Perry & Milton

[57] ABSTRACT

In a rotating container filling machine, the assembly (10) supplies liquid to a plurality of valves. The assembly (10) comprises a fixed tube (18), housed in a housing (16), supplying liquid to a distribution assembly (20) which mounts on and rotates with respect to the housing. The distribution assembly (20), including a rotating tube (22) and a cover (26), in turn supplies liquid to the valves (12) through conduits 24 for filling the containers (14). The rotating tube (22) telescopinigly engages in close tolerance within the fixed tube (18) and is rotatably supported therein by tube bearings (100, 102). The cover (26) of the distribution assembly (20) telescopingly engages over the housing (16) and is rotatably supported thereon with housing bearings (110, 112). The housing bearings (110, 112) includes upper (110) and lower (112) bearings disposed between the housing (16) and the cover (26). The assembly (10) includes a lubrication system (115) for supplying lubrication to both the upper (110) and lower (112) bearings. Finally, the assembly (10) includes a distribution head for gradually diverting the liquid from a generally vertical path to a horizontal one.

50 Claims, 5 Drawing Sheets

CENTER SUPPLY TUBE FOR A CONTAINER FILLING ASSEMBLY

BACKGROUND OF THE INVENTION

1. Field of the Invention

This invention relates to an improved machine for filling beverage containers such as bottles and cans. More particularly, the subject invention relates to an improved system of liquid supply tubes for supplying the container-filling valves.

2 Description of Related Art

Automatic machinery is used in modern bottling facilities for filling containers with carbonated and non-carbonated liquids containing carbon dioxide and similar carbonations. This machinery comprises a fixed upright liquid conducting tube housed in a housing for conducting liquid to a distribution assembly which is mounted on, and rotates relative to, the housing. The distribution assembly includes a plurality of distribution conduits which distribute the flow of liquid from the fixed tube to a filling valve assembly for simultaneously filling a plurality of containers.

A representative assembly in the prior art includes a cylindrical housing of standard diameter. A fixed liquid conducting tube is disposed concentrically within the housing, defining an annular space between the housing and the tube. The housing, the space and the tube share a central vertical axis. A rotating distribution assembly mounts on top of the housing and rotates with respect to the vertical axis. The distribution assembly includes a rotating liquid conducting tube for engaging the fixed liquid conducting tube and for conducting the liquid from it. The rotating tube specifically engages telescopingly in close tolerance over the fixed tube. The rotating tube also engages telescopingly within the housing.

A persistent problem of the beverage container filling art involves the rapid, economical and efficient filling of containers such as bottles or cans with carbonated liquids. Pressurized liquids, particularly carbonated liquids, have a tendency to foam when moving through a system of narrow tubes to the container-filling valve assembly. Foaming of the liquid undermines an even, uniform flow and requires greater pressure to move a given volume of liquid through the tubes to a destination. Elementary fluid flow principals hold that pressurized liquid flows more calmly through wider tubes. Yet several constraints on tube size in the standard liquid filling assembly render enlarging the tubes difficult.

A further problem in the assembly pertains to the lubrication of the bearings which rotatably support the distribution means on the housing. In the current system the distribution assembly is supported on the housing by upper and lower bearings. A lubrication system from the housing lubricates the lower bearing but fails to lubricate the upper bearing. The upper bearing thus wears faster than the lower bearing and may contribute to poor rotation characteristics of the distribution means on the housing.

SUMMARY OF THE INVENTION AND ADVANTAGES

A container filling assembly supplies liquid connection with filling valves of the type used for filling a plurality of containers with liquid by distributing liquid from a main fluid path to the several filling valves. The assembly comprises: a stationary support housing having an integral interior surface and an integral exterior surface; and fixed liquid conducting means wholly within and adjacent to the support housing and having a top end and a bottom end defining a central vertical axis extending therethrough for conducting liquid from the bottom end to the top end. The assembly also comprises fluid distribution means rotatably and axially moveable with respect to the vertical axis and the fixed liquid conducting means and operatively connected to the fixed liquid conducting means for distributing the liquid from the fixed liquid conducting means to a plurality of containers. The fluid distribution means includes at least one distribution conduit extending from the top end of the fixed liquid conducting means for directing the liquid to at least one remote location for supplying the filler valves with liquid. The assembly is characterized by the fluid distribution means including rotating liquid conducting means having a first end disposed in contacting and telescoping engaging within the top end of the fixed liquid conducting means and a second end extending beyond the housing means and connected to the distribution conduits for conducting the liquid from the fixed liquid conducting means to the distribution conduits.

The fixed tube thus has a larger inside diameter when it engages telescopingly around the rotating tube rather than when it engages within the rotating tube. The large fixed tube diameter allows more fluid to pass more calmly through the tube using less pressure. This improvement has been made without expensive or difficult changes to the rest of the standard assembly.

The container filling assembly further comprises covering means integral with the rotating distribution means, telescopingly engaging over and rotating with respect to the housing. The assembly also comprises housing bearing means disposed between the covering means and the housing and including an upper bearing disposed near the top end and a lower bearing disposed between the upper bearing and the bottom end for rotatably supporting the covering means on the housing means. The assembly is further characterized by the including lubrication means connected to the housing means for lubricating the upper and lower bearings to allow low friction rotation between the covering means and the housing means.

The container filling assembly generally includes one or more liquid conducting distribution conduits connected to the second end of the rotating liquid conducting means and adapted to be connected with the filling valves for receiving the liquid from the second end. The conduits are also for distributing the liquid to the filling valves. Each of the distribution conduits includes a receiving end connected to the second end for receiving liquid from the second end. The assembly is finally characterized by including a cylindrical or rectangular solid section through each of the receiving ends having sides and a distribution axis extending through the section parallel to the sides forming an acute angle with the central vertical axis for providing smooth flow of liquid between the second end and the receiving ends.

FIGURES IN THE DRAWINGS

Other advantages of the present invention will be readily appreciated as the same becomes better understood by reference to the following detailed description when considered in connection with the accompanying drawings wherein.

DESCRIPTION OF THE PREFERRED EMBODIMENT

Figure 1:
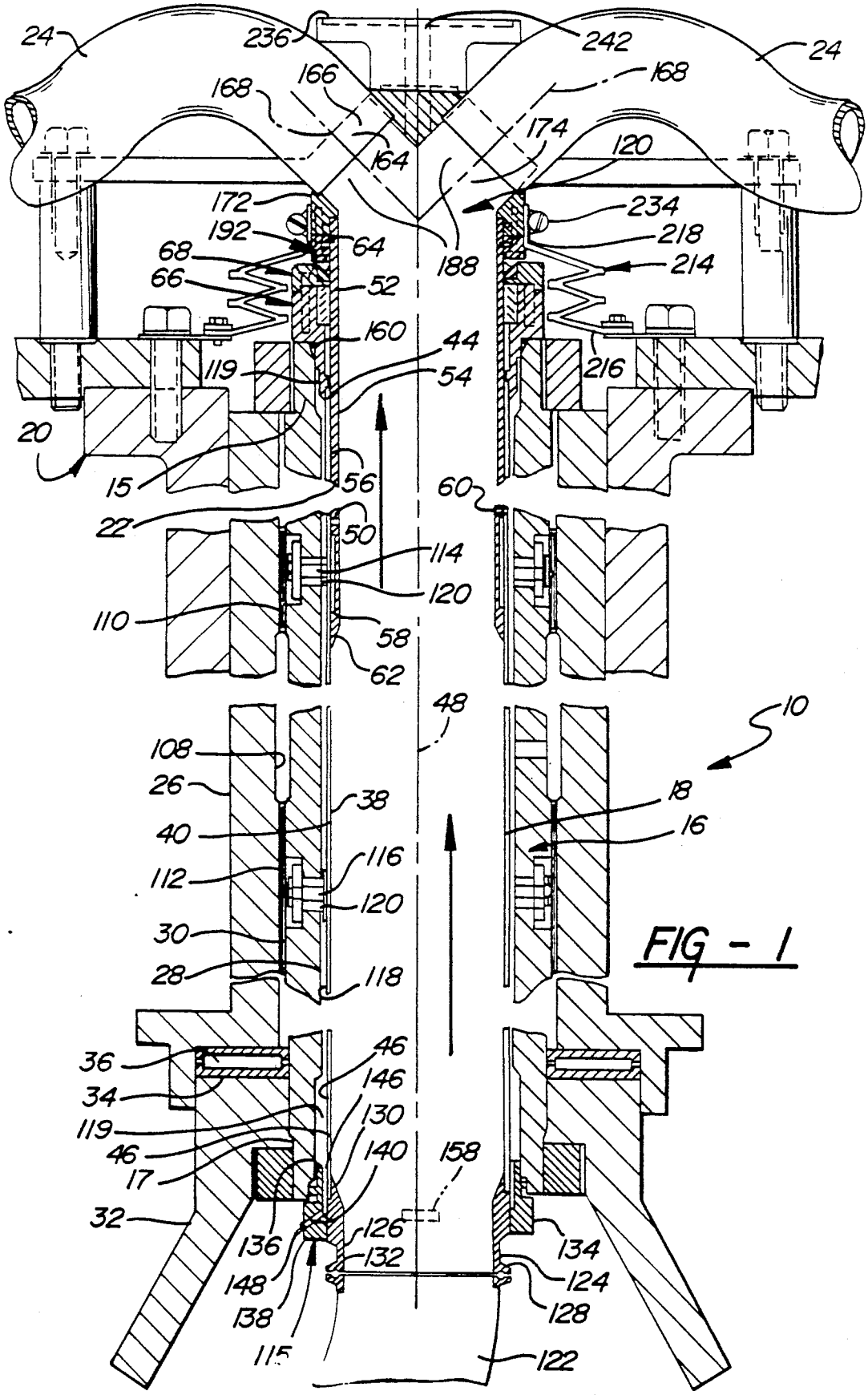
FIG. 1 is a side view of the subject invention partially in section.
Figure 2:
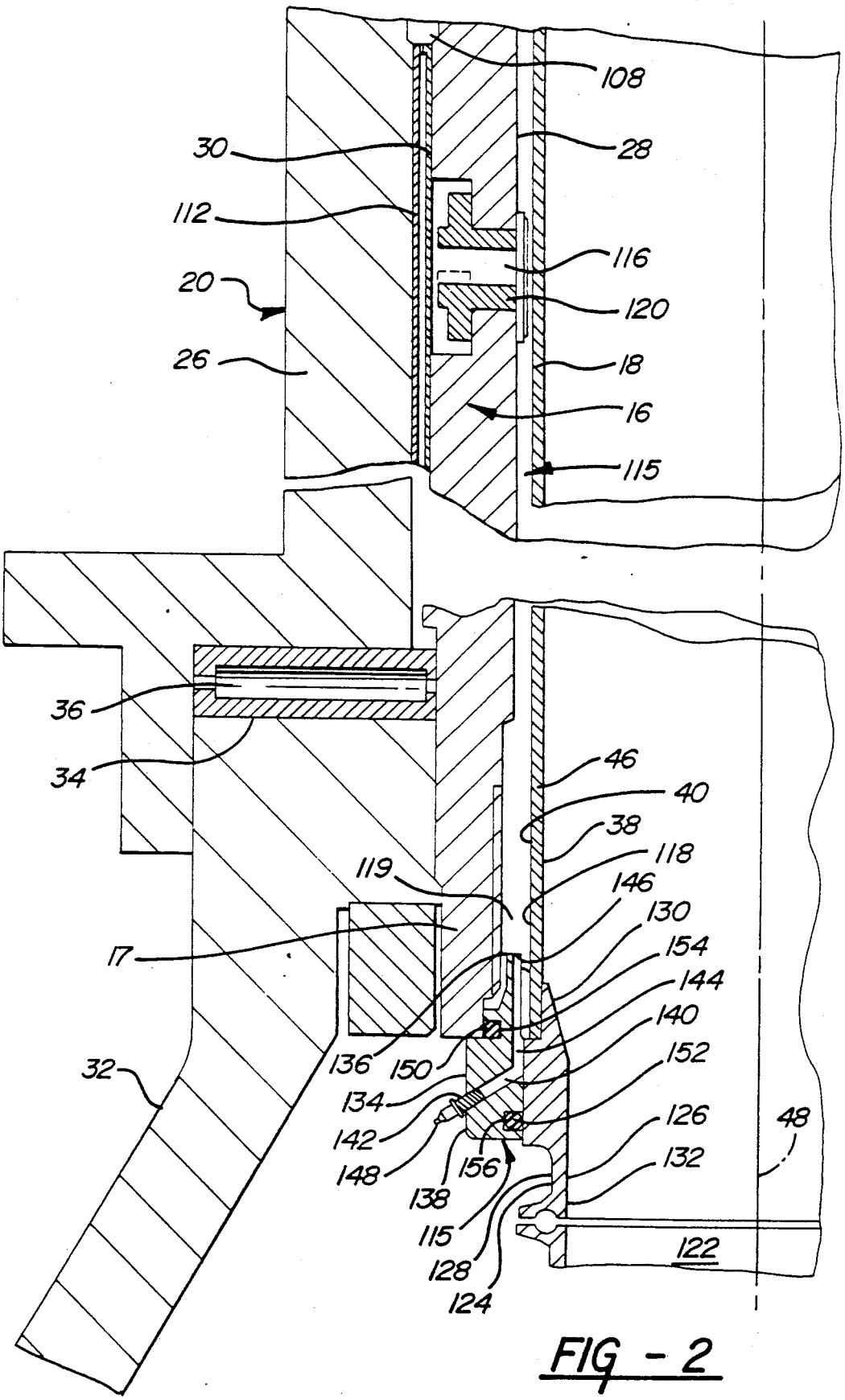
FIG. 2 is a side view partially in section enlarged showing the lower end of the subject invention.
Figure 3:
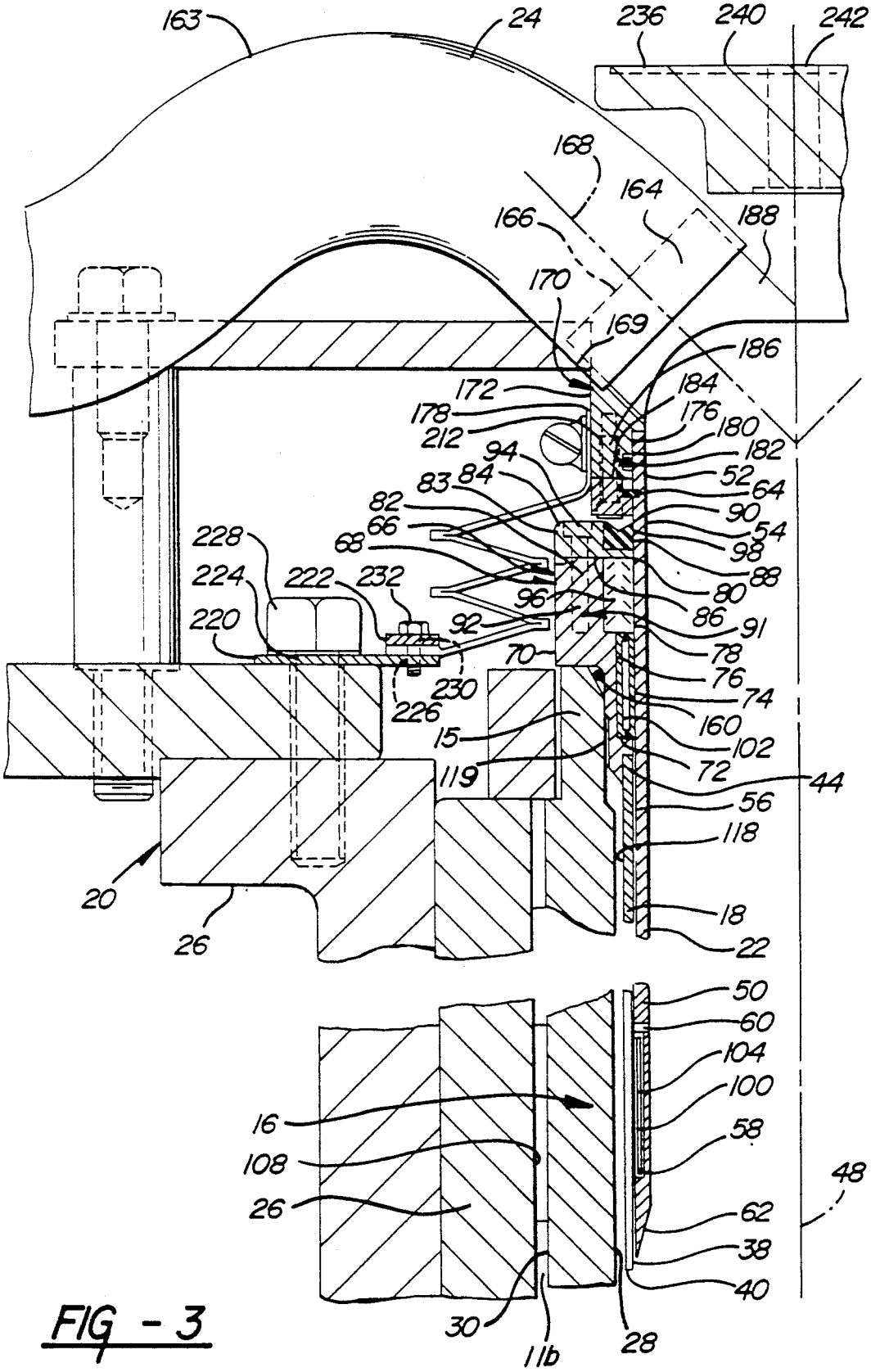
FIG. 3 is a side view partially in section enlarged showing the upper portion of the subject invention.
Figure 4:
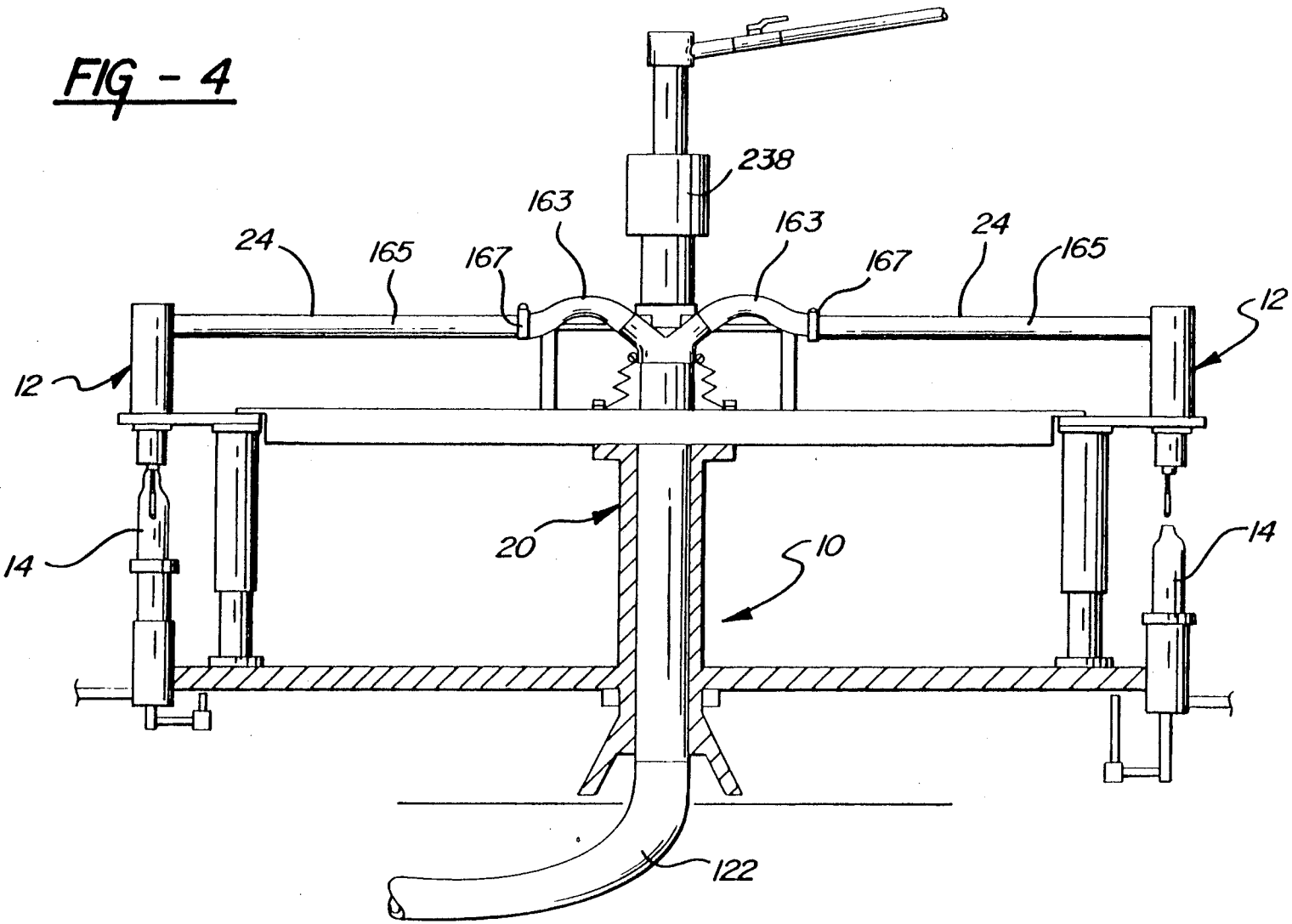
FIG. 4 is a side view partially in section showing the subject invention in a typical operating environment.
Figure 5:
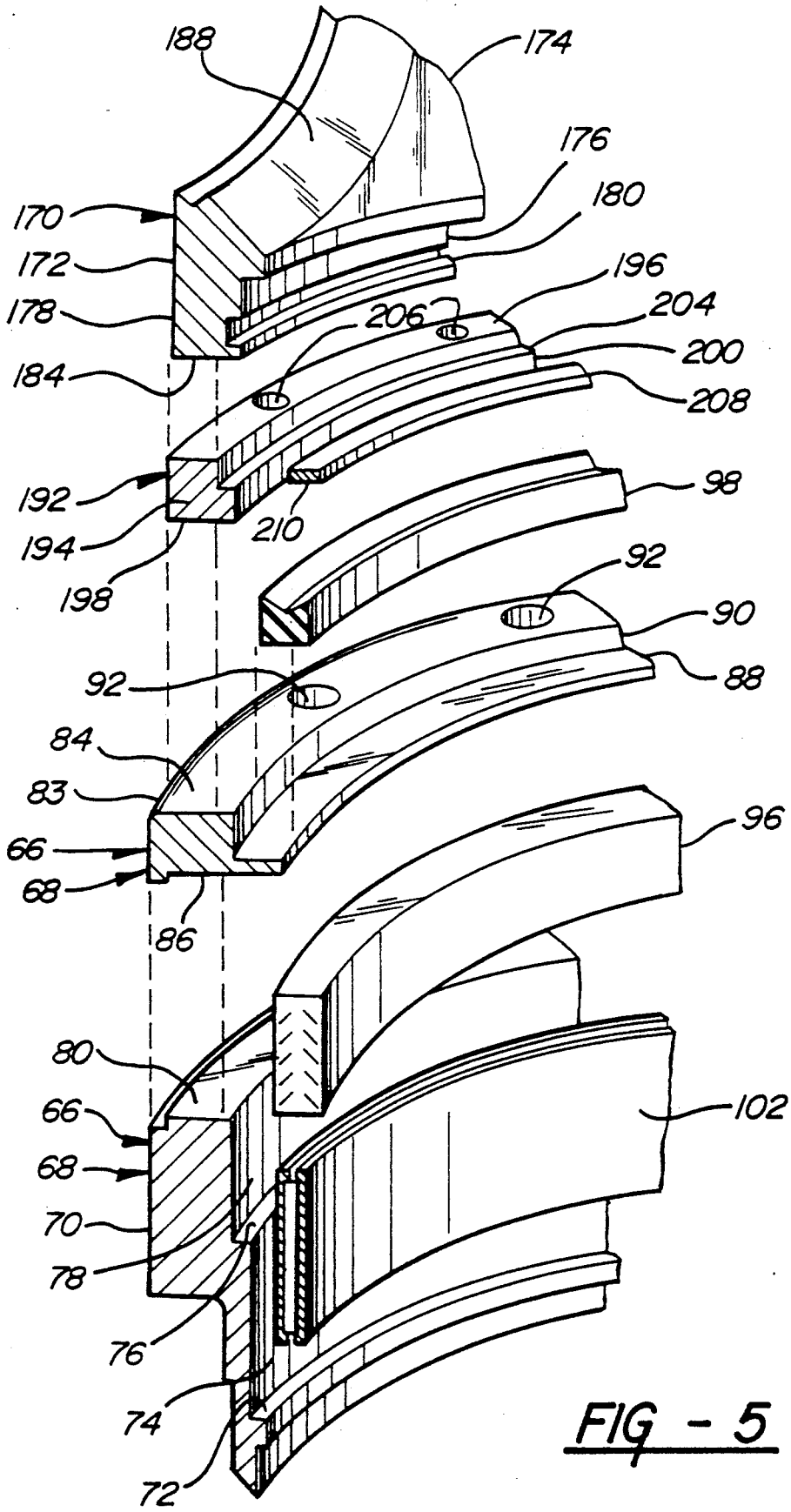
FIG. 5 is an exploded view showing portions of the sealing means and the head retaining means.

A container filling assembly is generally shown at 10 in the Figures. The assembly 10 supplies liquid connection between a beverage storage means (not shown) and filling valves generally shown at 12 of the type used for filling a plurality of containers 14 with liquid by distributing liquid from a main fluid path to several distribution paths leading eventually to the several filling valves. The assembly comprises a stationary support housing generally indicated at 16 and fixed liquid conducting means 18. The assembly 10 also comprises fluid distribution means, generally indicated at 20, which includes rotating liquid conducting means 22, at least one distribution conduit 24 and a covering means 26.

The stationary support housing 16 includes an integral (i.e., generally continuous and unbroken interior surface 28 and an integral (i.e. generally continuous and unbroken) exterior surface 30. This is to say that the housing 16 is generally unperforated, for reasons which will be explained later in the description. The housing 16 has a cylindrical shape with a high end 15 and a low end 17. A stand 32 supports the base of the housing 16 to maintain the housing in an upright position. The stand 32 includes an upwardly facing horizontal surface 34 which extends annularly around the housing 16. A thrust bearing 36 is disposed on the horizontal surface 34 for axially supporting the covering portion 26 of the distribution assembly 20 on the housing 16.

The fixed liquid conducting means 18 comprises a rigid, cylindrical fixed tube 18 having an inner surface 38 and an outer surface 40. The inner surface 38 must be sanitary since the liquid conducted over it is intended for human consumption. The fixed tube 18 is disposed fully within and adjacent to the support housing 16. The fixed tube 18 is concentric with the housing 16. The outer surface 40 is located adjacent to the housing 16 so that the fixed tube 18 and the housing define an annular space 118 therebetween. The fixed tube 18 has a top end 44 adjacent the high end 15 of the housing 16 and a bottom end 46 adjacent the low end 17 of the housing 16 defining a central vertical axis 48 extending therethrough. The fixed tube 18 conducts liquid from its bottom end 46 to its top end 44.

The fluid distribution means 20 is rotatably and axially moveable with respect to the vertical axis 48 of the fixed tube 18. The fluid distribution means 20 operatively connects to the fixed tube 18 for distributing the liquid from the fixed tube to a plurality of containers 14.

The fluid distribution means 20 includes at least one distribution conduit 24 extending from the top end 44 of the fixed tube 18 for directing the liquid to at least one remote location for supplying the filler valves 12 with liquid. The preferred embodiment of the distribution assembly 20 includes four such distribution conduit 24 spaced apart from each other. However, the assembly 20 may include as many as twelve or more distribution conduits 24 spaced equally apart from each other.

The fluid distribution means 20 further includes rotating liquid conducting means 22 having a first end 50 disposed in contacting and telescoping engagement with the top end 44 of the fixed tube 18 and a second end 52 extending beyond the housing means 16 and connected to the distribution conduits 24 for conducting the liquid from the fixed tube 18 to the distribution conduits 24. The rotating liquid conducting means 22 comprises a rigid cylindrical rotating tube 22 having a sanitary inner surface 54 conducting liquid, and an outer surface 56 rotatably and slidably disposed in close tolerance within the inner surface 38 of the fixed tube 18. The rotating tube 22 includes an annular notch 58 on its outer surface 56 at its first end 50. Two oppositely disposed drain holes 60 are machined through the rotating tube 22 above the level of the annular notch 58. The drain holes 60 enable the liquid to flow between the fixed tube 18 and the rotating tube 22. The rotating tube 22 at the first end 50 includes a bevelled portion 62 to facilitate the smooth flow of liquid from the fixed tube 18 into the rotating tube 22. The rotating tube 22 further includes an annular retaining groove 64 on its outer surface 56 at the second end 52.

The assembly 10 further includes sealing means generally indicated at 66 disposed between the inner surface 38 of the fixed tube 18 at its top end 44 and the outer surface 56 of the first end 50 of the rotating tube 22 for preventing the liquid from flowing past the sealing means.

The sealing means 66 includes sealing housing means generally indicated at 68 disposed on the top end 44 of the fixed tube 18 surrounding and contacting the first end 50 of the rotating tube 22. The sealing housing means 68 comprises a removable annular shoulder ring 70 welded to the top end 44 of the fixed tube 18 for housing the sealing means 66. A lower shoulder 72 in the shoulder ring 70 defines a lower annular space 74 between the shoulder ring and the rotating tube 22. An upper shoulder 76 defines an upper annular space 78 between the shoulder ring 70 and the rotating tube 22. The shoulder ring 70 includes a horizontal upper surface 80. Several fastener holes 82 are drilled perpendicularly into the upper surface 80.

The sealing housing means 68 further includes an annular cover ring 83 disposed on the upper surface 80 of the shoulder ring 70 and around the rotating tube 22. The cover ring 83 includes a top surface 84 and a bottom surface 86. The bottom surface 86 contacts the upper surface 80 of the shoulder ring 70. The cover ring 83 includes a shoulder 88 between the top 84 and bottom 86 surfaces defining an annular space 90 adjacent to and extending around the outer surface 56 of the rotating tube 22.

The sealing housing means 68 includes securing means generally indicated at 91 for securing the cover ring 83 to the shoulder ring 70. Several fastener holes 92 are drilled through the cover ring 83 from the top surface 84 to the bottom surface 86. The holes 92 match the fastener holes 82 drilled in the shoulder ring 70. Fasteners 94 including screws or dowels can be inserted into the fastener holes 82, 92 from the top surface 84 of the cover ring 83 to fasten the cover ring to the shoulder ring 70.

The sealing means 66 includes a dynamic sealing ring 96 supported in the upper space 78 defined by the shoulder ring 70. The sealing ring 96 contacts both the shoulder ring 70 and the rotating tube 22 to seal the liquid below the sealing ring. The sealing ring 96 is not fixed either to the rotating tube 22 or to the shoulder ring 70; so the sealing ring is free to rotate with respect to the shoulder ring.

The sealing means 66 further includes wiper means 98 supported by the sealing housing means 68 adjacent the outer surface 56 of the rotating tube 22 for preventing external contaminants from entering the sealing housing means. The wiper means 98 comprises a removable annular tube wiper ring 98 disposed within the annular space 90 of the cover ring 83 for contacting and wiping the rotating tube 22 as the rotating tube moves along the vertical axis 48 and for preventing external contaminants from entering the sealing housing means 68 when the rotating tube 22 telescopingly engages within the fixed tube 18. The assembly further includes tube bearing means 100, 102 projecting from the outer surface 56 of the rotating tube 22 contacting the inner surface 38 of the fixed tube 18 for rotatably supporting the rotating tube within the fixed tube. The tube bearing means 100, 102 includes a first bearing 100 and a second bearing 102. The first bearing 100 is disposed in the annular notch 58 on the outer surface 56 of the rotating tube 22. The first bearing 100 comprises a cylindrical tube having an axial break 104 therein. The axial break 104 allows the inner diameter of the first bearing 100 to be increased for allowing flexible clearance to position the first bearing 100 in the annular notch 58. The first bearing 100 contacts both the inner surface 38 of the fixed tube 18 and the outer surface 56 of the rotating to be 22.

The second bearing 102 is disposed in the lower annular space 74 between the shoulder ring 70 and the rotating tube 22 for rotatably supporting the rotating tube with respect to the fixed tube 18. The second bearing 102 contacts both the shoulder ring 70 and the outer surface 56 of the rotating tube 22.

The fluid distribution means 20 includes covering means 26 integral therewith telescopingly engaging over and rotating with respect to the housing 16. The covering means 26 comprises a cover 26 having a cylindrical inner surface 108 adjacent the housing 16. The distribution means 20 includes housing bearing means 110, 112 disposed between the cover 106 and the housing 16 including an upper bearing 110 disposed near the high end 15 and a lower bearing 112, spaced apart from the upper bearing 110 and disposed between the upper bearing 110 and the low end 17 for rotatably supporting the cover 26 with respect to the housing 16. Each bearing 110, 112 contacts both the cover 26 and the housing 16. The thrust bearing 36 supports the cover 26 on the base 32 as the cover rotates around the housing 16.

The assembly 10 includes lubrication means generally indicated at 115 connected to the housing 16 for lubricating the upper 110 and lower 112 bearings to allow friction-free rotation between the cover 26 and the housing 16.

The fixed tube 18 and the housing 16 define an annular reservoir space 118 therebetween having oppositely disposed ends 119 for collecting and storing lubrication. The housing 16 and the fixed tube 18 should be unperforated to retain the lubrication therebetween. The lubrication means 115 includes an upper passage 114 for conducting lubrication from the reservoir space 118 to the upper bearing 110. The lubrication means 115 also includes a lower passage 116 disposed below the upper passage 114 through the housing 16 for conducting lubrication from the reservoir space 118 to the lower bearing 112. Some of the lubrication from each passage 114, 116 passes down to lubricate the thrust bearing 36. Each passage 114, 116 includes a fitting 120 therein to facilitate the flow of lubrication to the bearing 110, 112.

The assembly 10 further includes a sanitary supply tube 122 which supplies the bottom end 46 of the fixed tube 18 with fluid. The supply tube 122 has a smaller diameter than that of the fixed tube 18. A sanitary transition ring 124 is disposed therebetween to provide a fluid connection. The transition ring 124 has a sanitary inner surface 126, an outer surface 128, a first end 130 telescopingly engaging in close tolerance with the bottom end 46 of the fixed tube 18 and a second end 132 disposed in fluid connection with the supply tube 122. The first end 130 is bevelled to provide a smooth fluid transition between the supply tube 122 and the fixed tube 18.

A sanitary clamp ring 134 clamps to the transition ring 124 and to the fixed tube 18. One function of the clamp ring 134 is to fix the fixed tube 18 with respect to the transition tube 124. The clamp ring 134 thus prevents "lift" of the fixed tube 18 when fluid flows through the fixed tube. The clamp ring 134 has a horizontal top surface 136 and at least one annular side surface 138. The clamp ring 134 is disposed between the housing 16 and the fixed tube 18 adjacent the bottom end 46 whereby one of the side surfaces 138 extends beyond the low end 17 and whereby the horizontal top surface 136 of the clamp ring 134 closes the end of the lubrication reservoir 118 adjacent the low end 17. The clamp ring 134 comprises a generally horizontal passage 140 having a first opening 142 on the side surface 138 of the clamp ring extending beyond the bottom end 46. The horizontal passage 140 fluidly connects with a vertical passage 144 having a second opening 146 disposed on the horizontal top surface 136. The vertical passage 144 is a channel formed between the clamp ring 134 and the outer surface 40 of the fixed tube 18. The horizontal passage 140 and the vertical passage 144 form a conduit for conducting lubrication from the first opening 142 to the second opening 146 and into the lubrication reservoir 118. The clamp ring 134 comprises a grease fitting 148 disposed within the horizontal passage 140 extending from the first opening 142. The clamp ring 134 further comprises a first lubrication seal 150 disposed between the clamp ring and the housing 16, and a second lubrication seal 152 disposed between the clamp ring and the transition ring 124. The seals are defined as sealing rings 150, 152. The clamp ring 134 includes annular grooves 154, 156 for receiving and retaining the sealing rings 150, 152, respectively. The clamp ring finally includes a clamp 158, usually a screw clamp, for tightening the fit of the clamp ring 134 around the transition ring 124.

The lubrication means 115 comprises a reservoir seal 160 between the housing 16 and the fixed tube 18 at the top end 44 for closing the end 119 of the reservoir 118 adjacent the high end. The reservoir seal 160 comprises a sealing ring.

The fluid distribution assembly 20 includes at least one distribution conduit 24. The preferred assembly 20 includes the use of four distribution conduits 24 spaced apart from one another at ninety degree intervals. However, the assembly 20 may include as many as twelve or more distribution conduits 24 spaced equally apart from each other. The distribution conduits 24 each include a curved section 163 disposed adjacent the second end of the rotating tube and a straight section 165 disposed adjacent the filling valves 12. The curved section 163 and the straight section 165 are joined with a joining clamp 167. Each distribution conduit 24 is disposed between the second end 52 of the rotating tube 22 and the valves 12, splitting and conducting the liquid to at least two remote locations for supplying the valves with liquid. The curved sections 163 each include a receiving end 164 adjacent the second end 52 of the rotating tube 22 for receiving liquid from the second end of the rotating tube. Each of the receiving ends 164 includes at least one cylindrical or rectangular solid section 166 having sides 169 and a receiving axis 168 parallel with the sides 169 forming an acute angle with the vertical axis 48. A rectangular solid is a rectangle translated into three dimensions. The acute angle formed by the receiving axis 168 and the vertical axis 48 is approximately forty-five degrees.

The fluid distribution means 20 further includes junction means generally indicated at 170 disposed between the second end 52 of the rotating tube 22 and the receiving ends 164 of the distribution conduits 24 for joining the distribution conduits to the second end of the rotating tube and for distributing the liquid from the rotating tube to the distribution conduits. The junction means 170 comprises a distribution head 170 having a cylindrical engaging portion 172 for telescopingly engaging in close tolerance over the second end 52 of the rotating tube 22, and a distribution portion 174 for dividing the liquid from the rotating tube and supplying the liquid to the distribution conduits 24.

The cylindrical engaging portion 172 of the distribution head 170 comprise's an inner surface 176 and an outer surface 178 and an annular seal groove 180 extending around the inner surface of the cylindrical portion. A sealing ring 182 is disposed in the seal groove 180. The cylindrical portion 172 includes a horizontal lower surface 184 through which several holes 186 are tapped.

The distribution portion 174 includes one straight conducting terminal 188 for each of the distribution conduits 24. Each conducting terminal 188 includes an axis therethrough coincident with the receiving axis 168 forming an acute angle with the vertical axis 48, for engaging telescopingly in close tolerance within the receiving end 164 of one of the distribution conduits 24 and for conducting liquid from the second end 52 to the distribution conduit.

The distribution means 20 further includes head retaining means generally indicated at 192 for retaining the distribution head 170 to the rotating tube 22. The retaining means 192 includes a retainer ring 194 extending around the second end 62 of the rotating tube 22. The retainer ring 192 has an upper surface 196 engaging the distribution head 170 and a lower surface 198 facing the annular cover ring 83 when the rotating tube 22 engages telescopingly within the fixed tube 18. The retainer ring 194 includes an inner surface 200 and an annular shoulder 204 extending from its inner surface 200 between the upper surface 196 of the ring and the lower surface 198 of the ring. A plurality of holes 206 are drilled through the retainer ring 194 from the lower surface 198 to the upper surface 196. These holes 206 are spaced to align with the holes 186 tapped into the distribution head 170. The distribution head 170 may be retained to the rotating tube 22 in other ways. For example, the distribution head 170 may be welded or bolted to the rotating tube 22.

A snap ring 208 is disposed in the retaining groove 64 for forming a retaining flange 210 for engaging the shoulder 204 and retaining the retainer ring 194 between the retaining flange 210 and the annular cover ring 83. The snap ring 208 may be made from any suitable material but is typically a piece of machine stock.

A fastening means 212 fastens the retainer ring 198 to the distribution head 170, whereby the distribution head is retained to the rotating tube 22. The fastening means 212, comprising the threaded bolts or screws 212, passes through the retainer ring 194 from the lower surface 198 to the distribution head 170.

The distribution means 20 further comprises outer sealing means generally indicated at 214 extending between the distribution head 170 and the covering means 26 for sealing moisture and foreign particles out of the telescoping engagement. The outer sealing means 214 comprises bellows 214 extending around the rotating tube 22 having a first end 216 and a second end 218. The first end 216 fastens to the cover 26, and the second end 218 fastens to the distribution head 170. The bellows 214 is made from impregnated filament or any other suitable material which can withstand ambient temperature and moisture. The bellows 214 includes a fastening ring 220 and a clamp ring 222 for fastening the first end 216 of the bellows to the covering portion 26. The fastening ring 220 has a diameter slightly greater than the diameter of the first end of the bellows 214. The fastening ring 220 includes inner 226 and outer 224 sets of holes arranged concentrically. Bolts, screws, rivets or other suitable fasteners 228 pass through the outer holes 224 to fasten the fastening ring 220 to the cover 26. The clamp ring 222 has holes 230 which align with the inner holes 226 on the fastening ring 220. To fasten the first end of the bellows 214 to the fastening ring 220, the first end 216 fits over the area of the fastening ring including the inner holes 226. The clamp ring 222 is placed over the first end 216 of the bellows 214, aligning the clamp ring holes 230 with the inner holes 226 of the fastening ring 220. Fasteners 232 then fit through the holes 222, 230 and secure the clamp ring 222, the bellows 214 and the fastening ring 220 together. The second end 218 of the bellows 214 attaches to the cylindrical portion 172 of the distribution head 170 with a hose clamp 234 or other suitable means.

The assembly 10 further includes a mounting head 236 fixedly disposed on the distribution head 170 for supporting a gas apparatus 238. The mounting head 236 has a flat, horizontal surface 240 having a circular shape. The mounting head 236 mounts to the top of the distribution portion 174 of the distribution head 170. The mounting head 236 mounts in the nest or pocket formed by the four straight conducting terminals 188. The mounting head 236 also includes a mounting means 242 for mounting the mounting head to the distribution portion 174.

In operation, a carbonated liquid flows from the supply tube 122 through the transition ring 124 into the fixed tube 18. The fluid then flows up through the fixed tube 18 into the rotating tube 22. As the liquid passes through the rotating tube 22 and into the distribution head 170, the liquid flow is divided into the four conducting terminals 188, which in-turn conduct the liquid into the distribution conduits 24. As the fluid passes into and through the distribution conduits 24 it is gently diverted from a generally vertical path to a generally horizontal path. Such a gentle transition reduces disturbance in the liquid which may result in foaming. The distribution conduits 24 supply the liquid to the filler valves 12, which fill the containers 14 with the liquid. Some liquid passes through the drain holes 60 and between the rotating tube 22 and the fixed tube 18, but this liquid is sealed in the assembly 10 by the sealing means 66. This liquid that passes between the rotating tube 22 and the fixed tube 18 in turn pressurizes the sealing means 66.

As the liquid flows through the entire assembly 10, the distribution assembly 20 including the rotating tube 22, the distribution head 170, the distribution conduits 24 and the cover 26 rotates around the vertical axis 48, and with respect to the fixed housing 16 and the fixed tube 18. At this time the rotating tube 22 may "lift" due to the upward flow of the liquid. This lifting can cause the lower surface 188 of the retainer ring 192 to separate several inches from the annular cover ring 83.

The tube bearings 100, 102 rotatably support the rotating tube 22 as it rotates with respect to the fixed tube 18. The tube bearings 100, 102 are lubricated by the liquid itself which was supplied from the drain holes 60 when the liquid first passed up through the fixed and rotating tubes 18, 22. The drain holes 60 also allow the liquid between the tubes, 18, 22 to escape after the pumping of liquid ceases.

The housing bearings 110, 112 rotatably support the cover 26 as it rotates with respect to the housing 16. The thrust bearing 36 axially supports the cover 26 on the housing 16. These bearings 110, 112 are lubricated by lubrication held in the reservoir 118 and supplied by the upper 114 and lower 116 passages through the housing 16.

The invention has been described in an illustrative manner, and it is to be understood that the terminology which has been used is intended to be in the nature of words of description rather than limitation.

Obviously, many modifications and variations of the present invention are possible in light of the above teachings. It is therefore to be understood that within the scope of the appended claims wherein reference numerals are merely for convenience and are not to be in any way limiting, the invention may be practiced otherwise than as specifically described.

What is claimed is:

1. A container filling assembly (10) for supplying liquid connection with filling valves (12) of the type used for filling a plurality of containers (14) with liquid by distributing liquid from a main fluid path to the filling valves, said assembly comprising:

a stationary support housing (16) having an integral interior surface (28) and an integral exterior surface (30);

fixed liquid conducting means (18) wholly within and adjacent to said support housing (16) and having a top end (44) and a bottom end (46) defining a central vertical axis (48) extending therethrough for conducting liquid from said bottom end to said top end;

fluid distribution means (20) rotatably and axially moveable with respect to said vertical axis (48) and said fixed liquid conducting means (18) and operatively connected to said fixed liquid conducting means for distributing the liquid from said fixed liquid conducting means to a plurality of containers (14);

said fluid distribution means (20) including at least one distribution conduit (24) having a receiving end (164) extending from said top end (44) of said fixed liquid conducting means (18) for directing the liquid to the fillings valves (12);

said assembly (10) characterized by said fluid distribution means (20) including rotating liquid conducting means (22) having a first end (50) disposed in contacting and telescoping engagement within said top end (44) of said fixed liquid conducting means (18) and a second end (52) extending beyond said housing means (16) and connected to said receiving end (164) of said distribution conduit (24) for conducting the liquid from said fixed liquid conducting means to said distribution conduit.

2. An assembly (10) as set forth in claim 1 further characterized by said fixed liquid conducting means (18) comprising a rigid cylindrical fixed tube having a sanitary inner surface (38) and an outer surface (40) adjacent said stationary support housing (16) for conducting the liquid to said rotating liquid conducting means (22).

3. An assembly (10) as set forth in claim 2 further characterized by said rotating liquid conducting means (22) comprising a rigid cylindrical rotating tube having a sanitary inner surface (54) conducting liquid and an outer surface (56) rotatably and slidably disposed within said fixed tube (18) and adjacent said inner surface (38) of said fixed tube.

4. An assembly (10) as set forth in claim 3 further characterized by said rotating tube (22) including tube bearing means (100, 102) projecting from said outer surface (56) of said rotating tube contacting said inner surface (38) of said fixed tube (18) for rotatably supporting said rotating tube within said fixed tube.

5. An assembly (10) as set forth in claim 4 further characterized by including sealing means (66) disposed between said inner surface (38) of said fixed tube (18) and said outer surface (56) of said rotating tube (22) for preventing the liquid from flowing past said sealing means.

6. An assembly (10) as set forth in claim 5 further characterized by said sealing means (66) including sealing housing means (68) disposed on said top end (44) of said fixed tube (18) surrounding and contacting said first end (50) of said rotating tube (22).

7. An assembly (10) as set forth in claim 6 further characterized by said sealing means (66) including a dynamic sealing ring (96) supported adjacent said rotating tube (22) by said sealing housing means (68) for preventing the liquid from flowing therepast and retaining the liquid below said top end (44) of said fixed tube (18).

8. An assembly (10) as set forth in claim 7 further characterized by said sealing housing means (68) including a removable annular shoulder ring (70) having a horizontal upper surface (80) fixed to said top end (44) of said fixed tube (18) for housing said dynamic sealing ring (96).

9. An assembly (10) as set forth in claim 8 further characterized by said sealing housing means (68) including an annular cover ring (83) disposed on said upper surface (80) of said shoulder ring (70) and around said rotating tube (22).

10. An assembly (10) as set forth in claim 9 further characterized by said sealing means (66) including wiper means (98) supported adjacent said outer surface (56) of said rotating tube (22) by said sealing housing means (68) for preventing external contaminants from entering said sealing housing means.

11. An assembly (10) as set forth in claim 10 further characterized by said wiper means (98) comprising a removable annular tube wiper ring disposed within said annular space (90) of said annular cover ring (83) for contacting and wiping said rotating tube (22) as said rotating tube moves along said vertical axis (48) and for preventing external contaminants from entering said sealing housing means (68) when said rotating tube telescopingly engages within said fixed tube (18).

12. An assembly (10) as set forth in claim 11 further characterized by said sealing housing means (68) including securing means (91) for securing said cover ring (83) to said shoulder ring (70).

13. An assembly (10) as set forth in claim 12 further characterized by said tube bearing means (100,102) including a first tearing (100) disposed between said outer surface (56) of said first end (50) of said rotating tube (22) and said inner surface (38) of said fixed tube (18) between said sealing housing means (68) and said bottom end (46) of said fixed tube (18) for rotatably supporting said rotating tube with respect to said fixed tube.

14. An assembly (10) as set forth in claim 13 further characterized by said tube bearing means (100,102) including a second bearing (102) disposed between said shoulder ring (70) and said rotating tube (22) for rotatably supporting said rotating tube with respect to said fixed tube (18).

15. An assembly (10) as set forth in claim 14 further characterized by said rotating tube (22) including an annular notch (58) on said outer surface (56) at said first end (50) for receiving and retaining said first bearing (100).

16. An assembly (10) as set for in claim 15 further characterized by said rotating tube (22) including a bevelled portion (62) at said first end (50) on said inside surface (54) for allowing a smooth flow of liquid from said fixed tube (18) to said rotating tube.

17. An assembly (10) as set forth in claim 16 further characterized by said first bearing (100) comprising a cylindrical tube-shaped bearing having an axial break (104) therein for allowing flexible clearance to position on said outer surface (56) cf said rotating tube (22).

18. An assembly (10) as set forth in claim 17 further characterized by said distribution means (20) including covering means (26) integral with said distribution means in telescoping engagement about said housing (16) for allowing extension of said distribution means with respect to said housing (16).

19. A container filling assembly (10) for supplying liquid connection with filling valves (12) of the type used for filling a plurality of containers (14) with liquid by distributing liquid from a main fluid path to the several filling valves (12), said assembly (10) comprising:

a fixed upright housing means (16) having a high end (15) and a low end (17) defining a central vertical axis (48) extending therethrough for conducting liquid from said low end to said high end;

rotating distribution means (20) operatively connected to said high end (15) and rotating about said vertical axis (48) for distributing liquid from said high end to a plurality of container filling valves (12), said rotating distribution means (20) including a covering means (26) integral therewith for telescopingly engaging over in a telescoping engagement and rotating with respect to said housing means (16) and for providing sliding engagement therebetween;

housing bearing means (110,112) disposed between said covering means (26) and said housing means (16) and including an upper bearing (110) disposed near said high end (15) and a lower bearing (12) disposed between said upper bearing and said low end (17) for rotatably supporting said covering means on said housing means;

said assembly (10) characterized by including lubrication means (115) connected to said housing means (16) for lubricating said upper (110) and lower (112) bearings to allow low friction rotation between said covering means (26) and said housing means.

20. An assembly (10) as set forth in claim 19 further characterized by including fixed liquid conducting means (18) having a top end (44) adjacent said high end (15) and a bottom end (46) adjacent said low end (17), wholly within said housing means (16) and extending along said vertical axis (48) for conducting liquid from said low end (15) to said high end (17) said fixed liquid conducting means and said housing means defining a reservoir space (118) therebetween having oppositely disposed ends (119) for collecting and storing lubrication.

21. An assembly (10) as set forth in claim 20 further characterized by said housing means (16) including an upper passage (114) for conducting lubrication from said reservoir space (118) to said upper bearing (110).

22. An assembly (10) as set forth in claim 21 further characterized by comprising a clamp ring (134) having a horizontal top surface (136) and at least one side surface (138), said clamp ring (134) disposed between said housing means (16) and said fixed liquid conducting means (18) adjacent said bottom end (46) whereby one of said side surfaces extends beyond said low end (17), and whereby said horizontal top surface (136) of said clamp ring (134) closes said end (119) of said lubrication reservoir adjacent said bottom end (46).

23. An assembly (10) as set forth in claim 22 further characterized by said clamp ring (134) comprising a generally horizontal passage (140) having a first opening (142) on said side surface (138) of said clamp ring extending beyond said bottom end (46), said horizontal passage (140) fluidly connecting with a vertical passage (144) having a second opening (146) disposed on said horizontal top surface (136), said horizontal passage (140) and said vertical passage (144) forming a conduit for conducting lubrication from said first opening (142) to said second opening (146).

24. An assembly (10) as set forth in claim 23 further characterized by said clamp ring (134) comprising a grease fitting (148) disposed in said horizontal passage (140) and extending from said first opening (142).

25. An assembly (10) as set forth in claim 24 further characterized by said clamp ring (134) comprising a first lubrication seal (150) disposed between said clamp ring and said housing means (16) and a second lubrication seal (152) disposed between said clamp ring and said fixed liquid conducting means (18).

26. An assembly (10) as set forth in claim 25 further characterized by said lubrication means (115) comprising a reservoir seal (160) between said housing means (16) and said fixed liquid conducting means (18) at said end (119) adjacent said high end (15) for closing said end (119) of said lubrication reservoir (118).

27. An assembly (10) as set forth in claim 26 further characterized by including a lower passageway (116) disposed between said upper passageway (114) and said low end (17) through said housing means (16) for conducting lubrication from said reservoir (118) to said lower bearing (112).

28. An assembly (10) as set forth in claim claim 27 further characterized by including one or more distribution conduits (24) each having a receiving end (164) disposed between said second end (52) of said rotating tube (22) and said filler valves (12) for receiving and conducting the liquid to at least one remote location for supplying the filler valves (12) with liquid.

29. An assembly (10) as set forth in claim 28 further characterized by each of said distribution conduits (24) including a receiving end (164) adjacent said second end (52) of said rotating tube (22) for receiving liquid from said second end.

30. An assembly (10) as set forth in claim 18 or 29 further characterized by each of said receiving ends (164) including at least one section (166) therethrough having parallel sides defining a receiving axis (168) parallel to said sides forming an acute angle with said vertical axis (48).

31. An assembly (10) as set forth in claim 30 further characterized by including junction means (170) disposed between said second end (52) of said rotating tube (22) and said receiving ends (164) of said distribution conduits (24) for joining said distribution conduits to said second end of said rotating tube and for distributing the liquid from said rotating tube to said distribution conduits.

32. An assembly (10) as set forth in claim 31 further characterized by said junction means (170) comprising a distribution head including a cylindrical engaging portion (172) for telescopingly engaging in close tolerance over said second end (52) of said rotating tube (22) and a distribution portion (174) for receiving the liquid from said rotating tube and supplying the liquid to said distribution conduits (24).

33. An assembly (10) as set forth in claim 32 further characterized by said distribution portion (174) including at least one straight conducting terminal (188) each including an axis therethrough coincident with said receiving axis (168) forming an acute angle with said vertical axis (48) for engaging telescopingly in close tolerance within said receiving end (164) of one of said distribution conduits (24) and for conducting liquid from said second end (52) to said distribution conduit.

34. An assembly (10) as set forth in claim 33 further characterized by comprising head retaining means (192) for retaining said distribution head (170) to said rotating tube (22).

35. An assembly (10) as set forth in claim 34 further characterized by said head retaining means (192) including an annular retaining groove (64) extending around said outer surface (56) of said rotating tube (22) at said second end (52).

36. An assembly (10) as set forth in claim 35 further characterized by said head retaining means (192) including a retainer ring (194) extending around said second end (52) having an upper surface (196) engaging said distribution head (170) and a lower surface (198) facing said annular cover ring (83) and an inner surface (200) and an outer surface (202), said retainer ring (194) including an annular shoulder (204) extending from said inner surface of said retainer ring (194) between said upper surface of said ring and said lower surface of said ring.

37. An assembly (10) as set forth in claim 36 further characterized by said head retaining means (192) including a snap ring (208) disposed in said retaining groove (64) forming a retaining flange (210) for engaging said shoulder (204) and retaining said retainer ring (194) between said retaining flange and said annular cover ring (83).

38. An assembly (10) as set forth in claim 32 further characterized by said head retaining means (192) comprising fastening means (212) for fastening said distribution head (170) to said retainer ring (194), whereby said distribution head is retained to said rotating tube (22).

39. An assembly (10) as set forth in claim 38 further characterized by said cylindrical engaging portion (172) of said distribution head (170) comprising an inner surface (176) and an outer surface (178) , said cylindrical portion (172) also including an annular seal groove (180) extending around said inner surface of said cylindrical portion.

40. An assembly (10) as set forth in claim 39 further characterized by said cylindrical engaging portion (172) including a sealing ring (182) disposed in said seal groove (180).

41. An assembly (10) as set forth in claim 40 further characterized by said distribution assembly (20) comprising outer sealing means (214) extending between said distribution head (170) and said covering means (26) for sealing moisture and foreign particles out of said telescoping engagement of said covering means and said housing (16).

42. An assembly (10) as set forth in claim 41 further characterized by said outer sealing means (214) comprising bellows extending around said rotating tube (22) having a first end (216) and a second end (218) , said first end (216) fastening to said covering means (26) and said second end (218) fastening to said distribution head (170).

43. An assembly (10) as set forth in claim 42 further characterized by comprising a mounting head (236) fixedly disposed on said distribution portion (174) of said distribution head (170).

44. An assembly (10) as set forth in claim 43 further characterized by said mounting head (236) including a flat, horizontal surface (240).

45. An assembly (10) as set forth in claim 44 further characterized by said bottom end (46) of said fixed tube (18) being fluidly connected with a sanitary fluid supply tube (122).

46. An assembly (10) as set forth claim 45 further characterized by comprising a sanitary transition ring (124) disposed between said fluid supply tube (122) and said fixed tube (18) for providing a smooth flow of liquid between said fluid supply tube and said fixed tube.

47. An assembly (10) as set forth in claim 46 further characterized by said clamp ring (134) being disposed around said transition ring (124) and said bottom end (46) of said fixed tube (18).

48. An assembly (10) as set forth in claim 47 further characterized by said clamp ring (134) comprising clamping means (158) for tightening said clamp ring around said transition ring (124) and said fixed tube (18) for fixing said fixed tube with respect to said transition ring (124).

49. A container filling assembly (10) for supplying liquid connection with filling valves (12) of the type used for filling a plurality of containers (14) with liquid by distributing liquid from a main fluid path to one or more distribution paths leading to the several filling valves, said assembly comprising:

a stationary support housing (16) having an integral interior surface (28) and integral exterior surface (30);

fixed liquid conducting means (18) wholly within and adjacent to said support housing (16) and having a top end (44) and a bottom end (46) defining a central vertical axis (48) extending therethrough for conducting liquid from said bottom end to said top end;

rotating liquid conducting means (22) having a first end (50) disposed in contacting and telescoping engagement with said top end (44) of said fixed liquid conducting means (18) and a second end (52) extending beyond said housing means (16), said first and second ends of said rotating liquid conducting means sharing said central vertical axis (48) with said fixed liquid conducting means;

one or more liquid conducting distribution conduits (24) having a receiving end connected to said second end (52) of said rotating liquid conducting means (22) for receiving the liquid from said second end and for supplying the liquid to the filling valves;

said assembly characterized by including a section (166) through each of said receiving ends (164) having parallel sides (169) and a distribution axis (168) extending through said section (166) parallel to said sides forming an acute angle with said central vertical axis (48) for providing smooth flow of liquid between said second end (52) and said receiving ends (164).

50. An assembly (10) as set forth in claim 49 further characterized by said acute angle being forty-five degrees.

* * * * *